US009661961B2

(12) United States Patent
Dowmont

(10) Patent No.: US 9,661,961 B2
(45) Date of Patent: May 30, 2017

(54) TOILET SEAT LIFTING APPARATUS

(71) Applicant: William Dowmont, Kilgore, TX (US)

(72) Inventor: William Dowmont, Kilgore, TX (US)

( * ) Notice: Subject to any disclaimer, the term of this patent is extended or adjusted under 35 U.S.C. 154(b) by 326 days.

(21) Appl. No.: 14/576,017

(22) Filed: Dec. 18, 2014

(65) Prior Publication Data

US 2016/0174782 A1 Jun. 23, 2016

(51) Int. Cl.
*A47K 13/10* (2006.01)

(52) U.S. Cl.
CPC ..... *A47K 13/10* (2013.01)

(58) Field of Classification Search
CPC ..... A47K 13/10
USPC ..... 4/246.1–246.5
See application file for complete search history.

(56) References Cited

U.S. PATENT DOCUMENTS 8,266,730 B2 * 9/2012 Ricca ..... A47K 13/10 4/246.1
9,104,369 B1 * 8/2015 Allen ..... G06F 1/1628
2009/0106885 A1 * 4/2009 Sagre ..... A47K 13/10 4/246.1
2016/0157684 A1 * 6/2016 Helfrich ..... A47K 13/10 4/246.3

* cited by examiner

*Primary Examiner* — Christine Skubinna
(74) *Attorney, Agent, or Firm* — Gulf Coast Intellectual Property Group

(57) ABSTRACT

A toilet seat lifting apparatus that is operable to assist a user in transitioning a conventional toilet seat intermediate its up and down position. The toilet seat lifting apparatus further includes a container body having a plurality of walls and a top forming an interior volume and further including an opening. A rotating arm member is secured proximate the top and includes a connection assembly secured thereto wherein the connection assembly is external to the container body. A connection assembly is mounted to the rotating arm member and includes a seat-engaging member operable to couple to a toilet seat. A lever arm is secured to the rotating arm member and includes a cable secured thereto. The cable extends from the lever arm over a upper support rod and terminates at a foot receiving member. An adhesive member is further included to secure the container body to a floor.

5 Claims, 1 Drawing Sheet

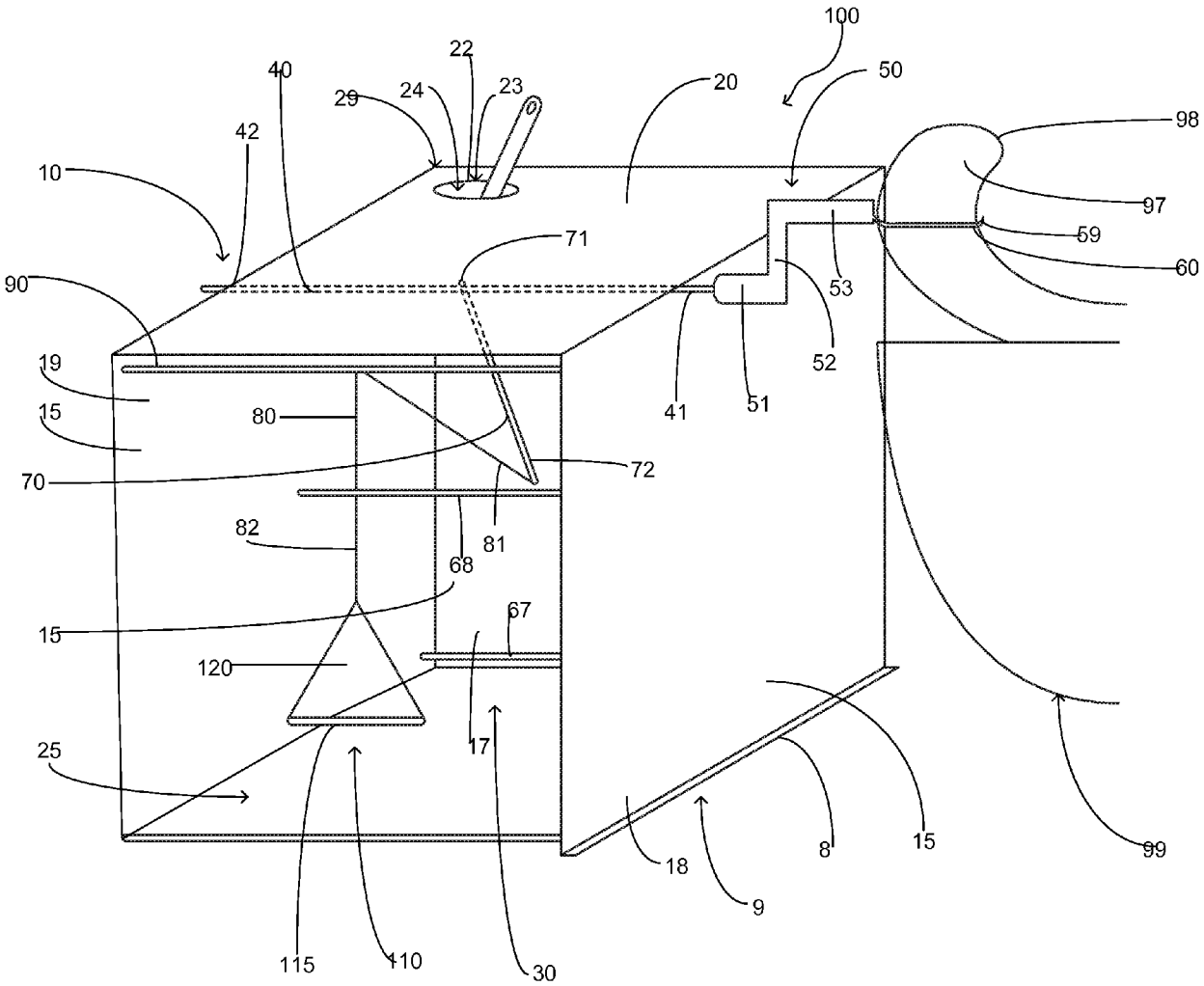
98
97
59
60
99
50
100
53
52
51
41
20
15
8
9
18
72
71
23
22
24
29
40
42
10
90
19
15
70
80
81
68
82
67
17
15
120
30
10
115
25

TOILET SEAT LIFTING APPARATUS

PRIORITY UNDER 35 U.S.C SECTION 119(e) & 37 C.F.R. SECTION 1.78

This nonprovisional application claims priority based upon the following prior U.S. Provisional Patent Application entitled: Toilet Seat Lifter, Application No. 61/921,429 filed Dec. 28, 2013, in the name of William Dowmont, which is hereby incorporated by reference for all purposes.

FIELD OF THE INVENTION

The present invention relates generally to bathroom accessories, more specifically but not by way of limitation, a toilet seat lifting apparatus that is operable to facilitate the lifting of a toilet seat with the use of a foot.

BACKGROUND

Toilet seat position has long been an issue that is debated in many households. Whether or not to leave the toilet seat up or down for the next person is sometimes heatedly discussed. Men will typically leave the toilet seat in the up position while women need the toilet seat in the down position to utilize the toilet. This debate has endured for decades and while many attempts have been made to solve this issue, it still remains largely unsolved.

One issue with transitioning the toilet seat intermediate its down position and its up position is that there are no devices that make the action quick and simple. Devices will use electric motors and sensors in an attempt to solve the aforementioned issue. Additionally, these devices are expensive which makes the implementation thereof cost prohibitive.

Another issue with current toilet seat lifters is their inability to assist in the storage of additional objects such as but not limited too cleaning supplies. Many toilet seat lifters occupy space that ultimately reduces the space available in the bathroom. Many bathrooms are small and have limited storage space.

Accordingly there is a need for a toilet seat lifter that is compact in size and easy to use while further providing storage space for cleaning supplies for a toilet.

SUMMARY OF THE INVENTION

It is the object of the present invention to provide a toilet seat lifting apparatus that is operable to be placed adjacent to a toilet and operably coupled to the seat thereof so as to transition the seat intermediate its up position and its down position.

Another object of the present invention is to provide a toilet seat lifting apparatus that is operable to transition a toilet seat between its up position and its down position that further includes a plurality of support walls that are integrally secured so as to form a container member.

A further object of the present invention is to provide a toilet seat lifting apparatus that functions to move a toilet seat intermediate its up an down position that further includes a plurality of support rods suspendedly secured within the interior volume of the container member.

An additional object of the present invention is to provide a toilet seat lifting apparatus that is operably coupled to a conventional toilet seat that functions to transition the toilet seat intermediate its up and down position that includes an opening located at the front side of the container.

Still another object of the present invention is to provide a toilet seat lifting apparatus that is operable to move a toilet seat intermediate its p and down position that includes a rotating arm member mounted within the interior volume of the container member.

Yet a further object of the present invention is to provide a toilet seat lifting apparatus that is operable to move a toilet seat between its down and up position that includes a lever arm coupled to the rotating arm member.

Another object of the present invention is to provide a toilet seat lifting apparatus that is operable to move a toilet seat intermediate its up and down position that includes a cable and handle assembly operably coupled to the lever arm.

A further object of the present invention is to provide a toilet seat lifting apparatus that is operable to move a toilet seat intermediate its up position and down position that includes a seat connection assembly operably coupled to the rotating arm member and a conventional toilet seat.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

The FIGURE is a front perspective view of the present invention.

DETAILED DESCRIPTION

Referring now to the drawings submitted herewith, wherein various elements depicted therein are not necessarily drawn to scale and wherein through the views and figures like elements are referenced with identical reference numerals, there is illustrated a toilet seat lifting apparatus 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms “a”, “an” and “the”

include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Now referring in particular to the FIGURE submitted herewith, the toilet seat lifting apparatus 100 further includes a container body 10. The container body 10 is manufactured from a plurality of support walls 15 and top 20 being formed to create an opening 25 and interior volume 30. The support walls 15 are manufactured from a durable suitable material such as but not limited to wood or plastic. The support walls 15 are secured utilizing suitable mechanical and/or chemical techniques and are generally rectangular in shape. The support walls 15 are formed to create a container body 10 that is rectangular in shape with the container body 10 being operable to be placed adjacent a conventional toilet 99 having seat 98. While the support walls 15 and the container body 10 have been illustrated herein as being rectangular in shape, it is contemplated within the scope of the present invention that the support walls 15 and container body 10 could be formed in numerous different shapes and still achieve the desired functionality as described herein. Proximate the bottom 9 of the container body 10 are adhesive members 8. Adhesive members 8 are manufactured from conventional pressure sensitive adhesives or similar material and function to secure the container body 10 to the floor adjacent the conventional toilet 99.

The top 20 includes a storage member 22 integrally formed therein. The storage member 22 is annular in shape and includes opening 23 providing access to interior volume 24. The storage member 22 functions to releasably secure therein items such as but not limited to a conventional toilet cleaning brush. The storage member 22 is located proximate distal corner 29 and is integrally formed within the top 20 utilizing suitable durable techniques. Locating the storage member 22 in the distal corner is optimal so as to reduce its impact on the operations of the toilet seat lifting apparatus 100. While the storage member 22 is described and illustrated herein as being annular in shape, it is contemplated within the scope of the present invention that the storage member 22 could be formed in numerous different shapes. Additionally, while only one storage member 22 has been illustrated herein, it is further contemplated within the scope of the present invention that more than one storage member 22 could be formed within the top 20.

The rotatable arm member 40 is mounted intermediate side support walls 18, 19 proximate the top 20. The rotatable arm member 40 is manufactured from a suitable durable material such as but not limited to non-corrosive metal. The rotatable arm member 40 is rotatably secured utilizing suitable durable techniques and includes a first end 41 and second end 42. First end 41 is journaled through sidewall 18 and has secured thereto a connection assembly 50. The connection assembly 50 functions to operably couple the rotating arm member 40 to the conventional toilet seat 98. The connection assembly 50 further includes a first portion 51, second portion 52 and third portion 53. The first portion 51, second portion 52 and third portion 53 are contiguously formed and are further joined such that each is positioned at a right angle with respect to its adjacent portion. A seat-engaging member 60 is secured to the third portion 53 of the connection assembly 50. The seat-engaging member 60 is manufactured from a suitable durable material and is secured to the bottom side 97 of the conventional toilet seat 98. The seat engaging member 60 is positioned rearward on the toilet seat 98 so as to ensure the toilet seat is lifted fully into its up position. The seat-engaging member 60 is planar in shape and manner and includes a second end 59 that is curved in shape so as to engage the toilet seat 98.

The rotating arm member 40 has secured thereto a lever arm 70. The lever arm 70 is manufactured from a suitable durable material such as but not limited to non-corrosive metal. The lever arm 70 is secured to the rotatable arm member 40 utilizing suitable durable techniques such as but not limited to welding. The lever arm 70 includes first end 71 and second end 72. The lever arm 70 is secured to the rotating arm member 40 proximate first end 71.

Secured to second end 72 of lever arm 70 is cable 80. Cable 80 is a conventional cable and is secured to the lever arm 70 utilizing suitable durable techniques. The cable 80 includes first end 81 and second end 82. First end 81 of cable 80 is secured to second end 72 of lever arm 70. Cable 80 is routed within the interior volume 30 such that it is superposed upper support rod 90 and hangs downward therefrom. Secured to the second end 82 of the cable 80 is the foot-receiving member 110. The foot-receiving member 110 is triangular in shape having bottom bar member 115 and void 120 that are operable to receive a portion of a human foot therein. The foot-receiving member 110 functions to transition the lever arm 70 thus rotating the rotating arm member 40 in order to move the toilet seat 98 intermediate its up and down position. When the seat 98 is in its down position, the lever arm 70 is positioned such that the second end 72 is directed towards the rear wall 17. The cable 80 extends from the second end 72 of the lever arm 70 and is routed such that it is superposed the upper support arm 90 and subsequently extends downward therefrom terminating at foot-receiving member 110. The bar member 115 of the foot-receiving member 110 is constructed from a heavier durable material so as to maintain a slight biased tension on cable 80 and further be constructed to repeatedly receive a portion of a human foot without damage.

As the foot-receiving member 110 is moved downward ensuing having a foot placed in the void 120 and superposed bar member 115 the lever arm 70 is moved to its second position wherein the second end 72 is moved towards opening 25. As the lever arm 70 is moved towards its second position the rotating arm member 40 rotates thus moving the connection assembly 50 in order to transition the seat 98 to its up position. The seat 98 is maintained in its up position provided a user maintains a foot within the foot-receiving member 110 and continues force thereon. Once a user desires to move the seat 98 to its down position, the user will remove the force applied to the foot-receiving member 110 and the lever arm 70 will return to its first position wherein the second end 72 is proximate and directed to the rear wall 17.

Mounted intermediate the sidewalls 18, 19 are additional support rod members 67,68. The support rod members 67, 68 are manufactured from a suitable durable material such as but not limited to non-corrosive metal. The support rod members 67,68 function to provide additional structural support for the container body 10. More specifically but not by way of limitation, during use, lateral forces may be generated and to inhibit any negative effects therefrom on the side walls 18, 19 the support rod members 67, 68 have been provided. While two support rod members 67,68 have been disclosed herein, it is contemplated within the scope of the present invention that any number of support rod members could be secured within the interior volume 30 of the container body 10.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A toilet seat lifting apparatus operable to transition a conventional toilet seat intermediate its up and down position comprising:

a container body, said container body being adjacent a conventional toilet, said container body having a first side wall and a second side wall, said container body having a rear wall intermediate said first side wall and said second side wall, said container body further including a top, said top extending intermediate said first side wall and said second side wall, said first side wall, said second side wall, said rear wall and said top forming an interior volume, said container body having an opening opposite said rear wall configured to provide access to said interior volume, wherein said container body further includes an adhesive member, said adhesive member being secured to said first side wall and said second side wall of said container body, said adhesive member operable to secure said container body to a floor;

a storage member, said storage member being integrally formed into said top of said container body, said storage member being annular in shape having an interior volume, said storage member being proximate said first side wall, said storage member operable to receive a cleaning brush therein;

an upper support rod, said upper support rod being mounted intermediate said first side wall and said second side wall of said container body, said upper support rod being mounted proximate said top;

a rotating arm member, said rotating arm member being rotatably mounted intermediate said first side wall and said second side wall, said rotating arm member having a first end and a second end, said first end being journaled through and extending outward from said second side wall, said second side wall being adjacent said conventional toilet;

a connection assembly, said connection assembly operably coupled to said first end of said rotating arm member, said connection assembly having a first portion, second portion and a third portion, said connection assembly operably coupled to a conventional toilet seat proximate said third portion;

a lever arm, said lever arm operably coupled to said rotating arm member, said lever arm disposed within said interior volume of said container body, said lever arm having a first end and a second end, said first end of said lever arm being secured to said rotating arm member, said lever arm having a first position and a second position;

a cable, said cable being operably secured to said lever arm, said cable having a first end and a second end, wherein said cable is routed from said second end of said lever arm and superposed said upper support rod with said foot-receiving member being beneath said upper support rod;

a foot-receiving member, said foot-receiving member disposed within said interior volume of said container body, said foot receiving member being proximate said opening of said container body, said foot-receiving member having an upper end and a lower end, said foot-receiving member further including a void operable to receive a portion of a human foot therein, wherein said foot-receiving member is triangular in shape, said foot-receiving member further including a bar member, said bar member being proximate the lower end of said foot-receiving member; and wherein said foot-receiving member has a first position and a second position.

2. The toilet seat lifting apparatus as recited in claim 1, wherein in said second position, said lever arm is directed toward said opening of said container body and the conventional toilet seat is in its up position.

3. A toilet seat lifting apparatus operable to facilitate the moving of a toilet seat intermediate its up position and its down position without the use of hands comprising:

a container body, said container body being adjacent a conventional toilet, said container body having a first side wall and a second side wall, said container body having a rear wall intermediate said first side wall and said second side wall, said container body further including a top, said top extending intermediate said first side wall and said second side wall, said first side wall, said second side wall, said rear wall and said top forming an interior volume, said container body having an opening opposite said rear wall configured to provide access to said interior volume;

an upper support rod, said upper support rod being mounted intermediate said first side wall and said second side wall of said container body, said upper support rod being mounted proximate said top;

a rotating arm member, said rotating arm member being rotatably mounted intermediate said first side wall and said second side wall, said rotating arm member having a first end and a second end, said first end being journaled through and extending outward from said second side wall, said second side wall being adjacent a conventional toilet;

a connection assembly, said connection assembly operably coupled to said first end of said rotating arm member, said connection assembly having a first portion, second portion and a third portion, said connection assembly operably coupled to said toilet seat proximate said third portion;

a lever arm, said lever arm operably coupled to said rotating arm member, said lever arm disposed within said interior volume of said container body, said lever arm having a first end and a second end, said first end of said lever arm being secured to said rotating arm member, said lever arm having a first position and a second position;

a seat engaging member, said seat engaging member being planar in manner and adjacent a bottom side of said toilet seat, said seat engaging member having a first end and second end, said second end being curved in shape and distal to said connection assembly;

a cable, said cable being operably secured to said lever arm, said cable having a first end and a second end, wherein said cable is routed from said second end of said lever arm and superposed said upper support rod with said foot-receiving member being beneath said upper support rod;

a foot-receiving member, said foot-receiving member disposed within said interior volume of said container body, said foot receiving member being proximate said opening of said container body, said foot-receiving member having an upper end and a lower end, said foot-receiving member further including a void operable to receive a portion of a human foot therein;

an adhesive member, said adhesive member being secured to said first side wall and said second side wall, said adhesive member operable to secure said container body to a floor; and wherein said foot-receiving member has a first position and a second position.

4. The toilet seat lifting apparatus as recited in claim 3, wherein in said second position, said lever arm is directed toward said opening of said container body and the conventional toilet seat is in its up position.

5. The toilet seat lifting apparatus as recited in claim 4, and further including a storage member, said storage member being integrally formed into said top of said container body, said storage member being annular in shape having an interior volume, said storage member being proximate said first side wall, said storage member operable to receive a cleaning brush therein.

* * * * *